US010981268B2

(12) United States Patent
Hermansen et al.

(10) Patent No.: US 10,981,268 B2
(45) Date of Patent: Apr. 20, 2021

(54) MULTIPLE TOOL WITH INTEGRATED CASE

(71) Applicant: Crank Brothers, Inc., Laguna Beach, CA (US)

(72) Inventors: Frank Hermansen, Laguna Beach, CA (US); Carl Winefordner, Laguna Beach, CA (US)

(73) Assignee: CRANK BROTHERS, INC., Laguna Beach, CA (US)

( * ) Notice: Subject to any disclaimer, the term of this patent is extended or adjusted under 35 U.S.C. 154(b) by 425 days.

(21) Appl. No.: 14/820,373

(22) Filed: Aug. 6, 2015

(65) Prior Publication Data

US 2016/0039085 A1 Feb. 11, 2016

(51) Int. Cl.

| | |
|---|---|
| ***B25G 1/08*** | (2006.01) |
| ***B25G 1/04*** | (2006.01) |
| ***B25B 13/50*** | (2006.01) |
| ***B25B 27/22*** | (2006.01) |
| ***B25B 13/56*** | (2006.01) |
| ***B25B 15/02*** | (2006.01) |
| ***B25H 3/00*** | (2006.01) |
| ***B25F 1/04*** | (2006.01) |
| ***B25B 27/00*** | (2006.01) |

(52) U.S. Cl.

CPC ..... *B25G 1/085* (2013.01); *B25B 13/50* (2013.01); *B25B 13/56* (2013.01); *B25B 15/02* (2013.01); *B25B 27/0071* (2013.01); *B25B 27/22* (2013.01); *B25F 1/04* (2013.01); *B25H 3/006* (2013.01)

(58) Field of Classification Search

CPC ..... B25G 1/085; B25B 13/50; B25B 13/56; B25B 15/02; B25B 27/0071; B25B 27/22; B25B 15/00; B25B 9/00; B25F 1/04; B25F 1/00; B25H 3/006; B21L 21/00

See application file for complete search history.

(56) References Cited

U.S. PATENT DOCUMENTS

| | | | | |
|---|---|---|---|---|
| 6,112,351 | A * | 9/2000 | Hawkins | B25B 27/0071 7/118 |
| 6,520,054 | B1 * | 2/2003 | Wang | B25B 13/56 224/425 |
| 7,306,366 | B1 * | 12/2007 | Camenzind | G01G 19/54 374/141 |
| 7,900,540 | B1 * | 3/2011 | Te | B25F 1/04 7/128 |
| 8,413,556 | B2 * | 4/2013 | Chuang | B25B 13/56 157/1.3 |
| 8,490,523 | B2 * | 7/2013 | Tsai | B25F 1/04 7/118 |
| 9,457,460 | B2 * | 10/2016 | Hermansen | B25F 1/02 |
| 9,650,234 | B1 * | 5/2017 | Oakley | B67B 7/44 |
| 10,131,393 | B2 * | 11/2018 | Chuang | B62J 9/40 |
| 2002/0062527 | A1 * | 5/2002 | Harrison | B25F 1/04 7/128 |

(Continued)

*Primary Examiner* — Monica S Carter
*Assistant Examiner* — Marcel T Dion
(74) *Attorney, Agent, or Firm* — Haynes and Boone, LLP

(57) ABSTRACT

A multiple tool with an integrated case is described. The multiple tool includes a tool assembly that includes a first pivot on which are articulated a plurality of implements, each implement rotatable from an inactive position of minimum encumbrance to at least a working position, and a carry case for housing the tool assembly. The carry case includes at least a grip portion for manually holding the tool assembly with at least one of the implements in a working position.

11 Claims, 6 Drawing Sheets

(56) References Cited

U.S. PATENT DOCUMENTS

| | | | | |
|---|---|---|---|---|
| 2002/0178875 | A1* | 12/2002 | Lin | B25F 1/02 81/437 |
| 2005/0183552 | A1* | 8/2005 | Hawkins | B25B 13/56 81/440 |
| 2005/0217032 | A1* | 10/2005 | Bruggisser | B25C 5/0214 7/119 |
| 2005/0223497 | A1* | 10/2005 | Wang | B25B 27/22 7/138 |
| 2007/0251355 | A1* | 11/2007 | Kao | B25B 23/0035 81/177.4 |
| 2008/0223181 | A1* | 9/2008 | Cline | B25B 13/56 81/124.2 |
| 2009/0183609 | A1* | 7/2009 | Johnson | B25G 1/08 81/436 |
| 2010/0132125 | A1* | 6/2010 | Wu | B25F 1/04 7/118 |
| 2012/0152068 | A1* | 6/2012 | Liu | B25F 1/04 81/440 |
| 2012/0255273 | A1* | 10/2012 | Wang | B25B 27/22 59/7 |
| 2013/0025071 | A1* | 1/2013 | Keng | B25F 1/003 7/118 |
| 2014/0102267 | A1* | 4/2014 | Hermansen | B25B 15/008 81/490 |
| 2014/0165293 | A1* | 6/2014 | Hermansen | B25B 13/56 7/168 |
| 2014/0182418 | A1* | 7/2014 | Chen | B25B 27/0071 76/117 |
| 2016/0325423 | A1* | 11/2016 | Ellis | B25F 1/04 |
| 2017/0042307 | A1* | 2/2017 | Blunt | A45D 29/18 |
| 2020/0253364 | A1* | 8/2020 | Myers | B25H 3/00 |

* cited by examiner

MULTIPLE TOOL WITH INTEGRATED CASE

CROSS REFERENCE TO RELATED APPLICATION

This application claims priority from Italian Patent Application No. VR2014A000209, filed on Aug. 8, 2014 in the Italian Patent and Trademark Office, the disclosure of which is incorporated herein by reference in its entirety.

BACKGROUND

Technical Field

The present invention relates to a multiple tool with an integrated case.

More specifically, the present invention relates to a multiple tool with an integrated case for the maintenance and repair of motorcycles, bicycles and the like, and their mechanical parts.

Related Art

Multiple tools are known, particularly of the pocket type and then rather small, which allow the user to bring together in one portable object a number of implements, each one for a different use.

Some examples of these implements are wrenches, allen keys, screwdrivers, and the like.

Some known types of multiple tools are especially dedicated to the care, maintenance and repair of mechanical parts for cycles and motorcycles.

The user can then bring with himself the multiple tool, for example, when making excursions or trips by bicycle or motorcycle, so he can work out emergency situations, such as mechanical damage to the medium, boring tire punctures, and more.

Alternatively, the multiple tool can be simply used to make quick adjustments to the medium itself, such as raise or lower the saddle, mount or dismount accessories, and so on.

Portable multiple tools of the known type generally comprise a pivot around which said implements, adjacent one another, are rotatable from a minimum encumbrance retracted position to a working position: this working position is reached by manually rotating the implement around the pivot, starting from the retracted position, by a certain angle comfortable enough to use the implement by gripping the multiple tool.

In order to achieve enough leverage, multiple tools need to be of a certain length, which results in a greater weight compared to a shorter tool.

Some multiple tools have a case for storage, when not in use.

The cases are typically made of either a soft textile, of a polymer, or of aluminum.

The entire purpose of the case is to keep the multiple tool in a closed stowed position or to protect the tool from the environment when not in use.

SUMMARY

A light weight multiple tool with integrated case that is more convenient to carry and use is described.

A multiple tool with integrated case which can achieve optimum leverage during use is also described.

The multiple tool comprises a tool assembly provided with at least a pivot on which are articulated a plurality of implements, each rotatable from an inactive position of minimum encumbrance to at least a working position, and a carry case for housing the tool assembly.

According to an aspect of the invention, the carry case comprises at least a grip portion for manually holding the tool assembly with at least one of the implements in its respective working position.

The carry case further comprises a housing for the tool assembly and a first opening for selectively extracting the tool assembly from said housing.

The first opening comprises a respective first cutout for pivoting at least one of said implements in the respective working position.

The carry case further comprises a second opening defining a seat for a respective separate implement, which comprises a chain breaker and/or a spoke wrench.

The carry case comprises first retention means of the tool assembly, and second retention means of the separate implement inside the housing.

BRIEF DESCRIPTION OF THE FIGURES

These and other advantages will be better understood by any man skilled in the art from the following description that follows and from the attached drawings, given as a non-limiting example, in which.

DETAILED DESCRIPTION

Figure 1:
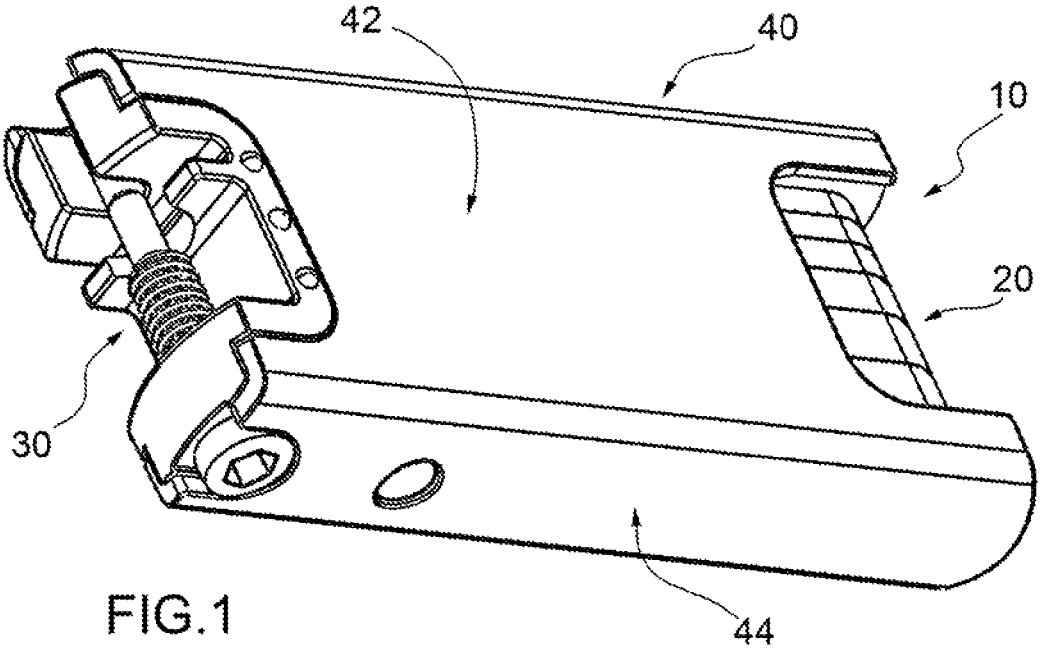
FIG. 1 is a perspective view of the multiple tool according to an embodiment of the present invention.

With reference to the schematic representation of FIG. 1, a multiple tool with integrated case according to the present invention is wholly indicated with 10.

In the following embodiments, individual characteristics, given in connection with specific embodiments, may actually be interchanged with other different characteristics that exist in other embodiments.

The multiple tool 10 comprises a tool assembly 20.

The tool assembly 20 is provided with at least a pivot 22,24, on which a plurality of implements 170 are articulated.

Some examples of these implements 170 are wrenches, alien keys, screwdrivers, and the like, having different shapes/sizes, without limitations.

Each implement 170 is rotatable around the pivot 22,24 from an inactive position of minimum encumbrance, to at least a working position, as it will be better disclosed hereafter.

The multiple tool 10 further comprises a carry case 40, for housing the tool assembly 20 when not in use.

According to an aspect of the present invention, the carry case 40 comprises at least a grip portion 42 for manually holding the tool assembly 20 when at least one of the implements 170 in its respective working position.

As better explained hereafter, thanks to this feature the carry case 40 can be used to achieve optimum manual leverage when using one of the implements 170.

When necessary, the tool assembly 20 can also be partially extracted from the carry case 40, in order to increase the manual leverage when using one of the implements 170.

The user can therefore achieve greater manual leverage in comparison with the multiple tools of the known type.

In consequence of this, the multiple tool can be shorter than usual, lighter in weight than other multiple tools with comparable tool functions, while being easier to use, more comfortable to carry, and more compact in total size.

The grip portion 42 is foreseen on the external surface 44 of the carry case 40.

In order to increase comfort in handling the multiple tool 10, the grip portion 42 of the carry case 40 can be provided with a soft outer coating, like a padding or the like.

The carry case 40 is substantially rectangular tubular shaped.

Other different shapes of the carry case 40 can be conceived in accordance with specific requirements, with no limitations.

The carry case 40 is suitable for keeping the implements 170 of the tool assembly 20 closed during storage, and to protect the user from the tool's sharp edges while holding or carrying it.

The carry case 40 can be made, for example, of light polymeric material, aluminum, steel, magnesium, carbon fiber, or other suitable material. Aluminum is ideally suited if starting with an extrusion.

The carry case 40 comprises a housing 100 for the tool assembly 20.

Figure 4:
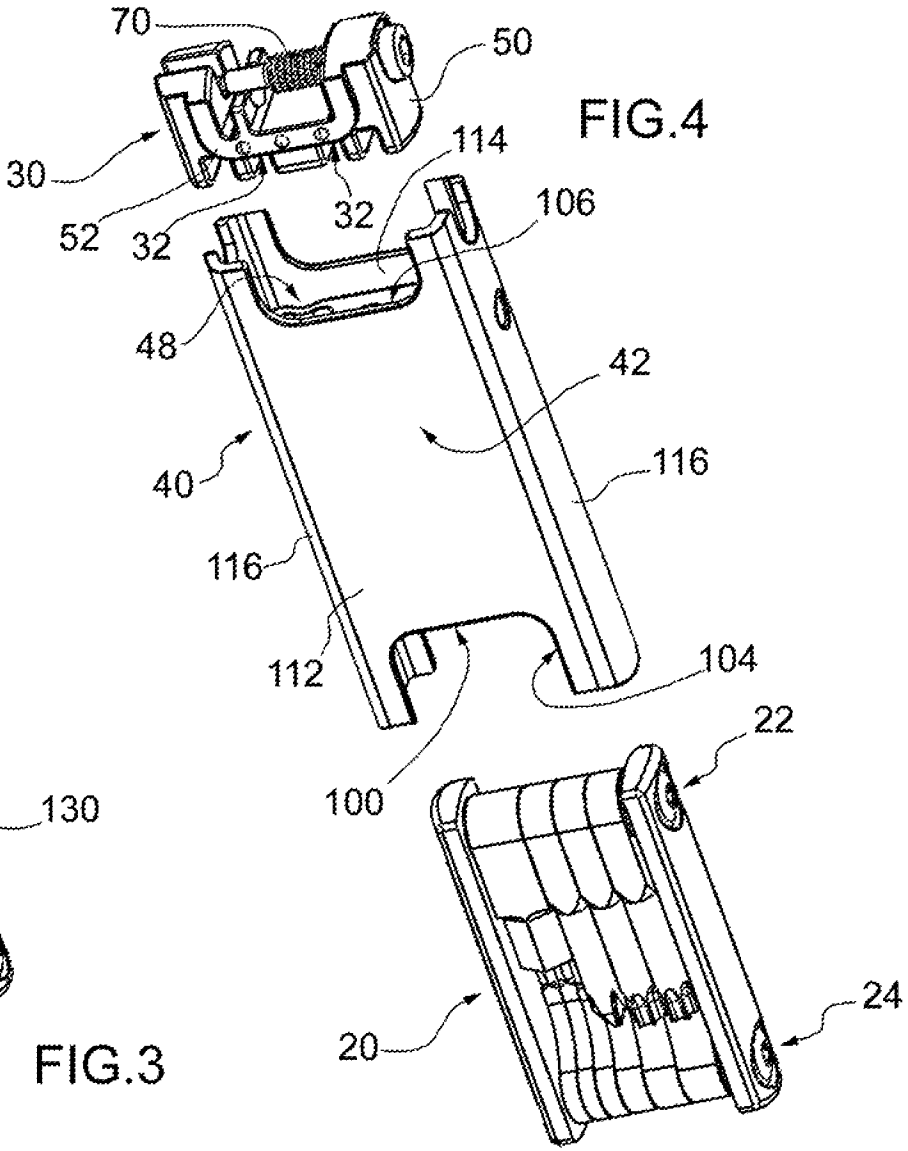
FIG. 4 is another partially exploded view of the multiple tool according to an embodiment of the present invention.

As indicated in FIG. 4, the housing 100 is defined by a front wall 112, a rear wall 114, and side walls 116 of the carry case 40.

Figure 3:
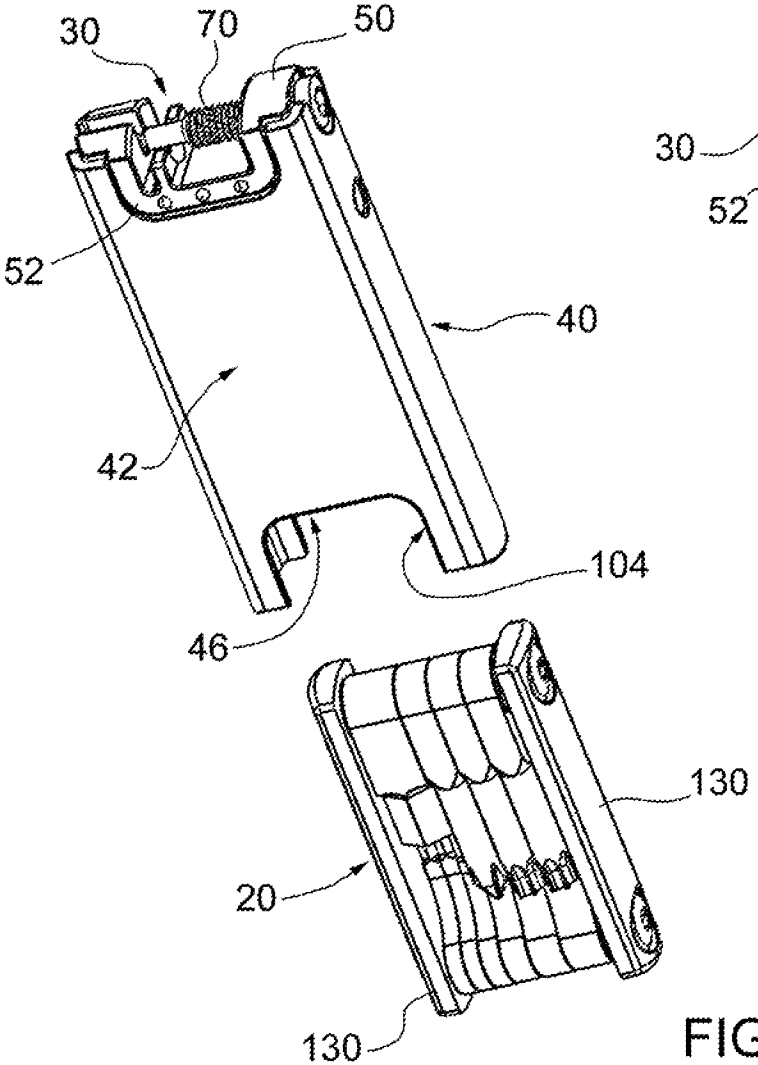
FIG. 3 is a partially exploded view of the multiple tool according to an embodiment of the present invention.

The carry case 40 further comprises a first opening 46 of the housing 100, see FIG. 3.

The first opening 46 is suitable for selectively extracting the tool assembly 20 from the housing 100, as better disclosed hereafter.

Figure 5:
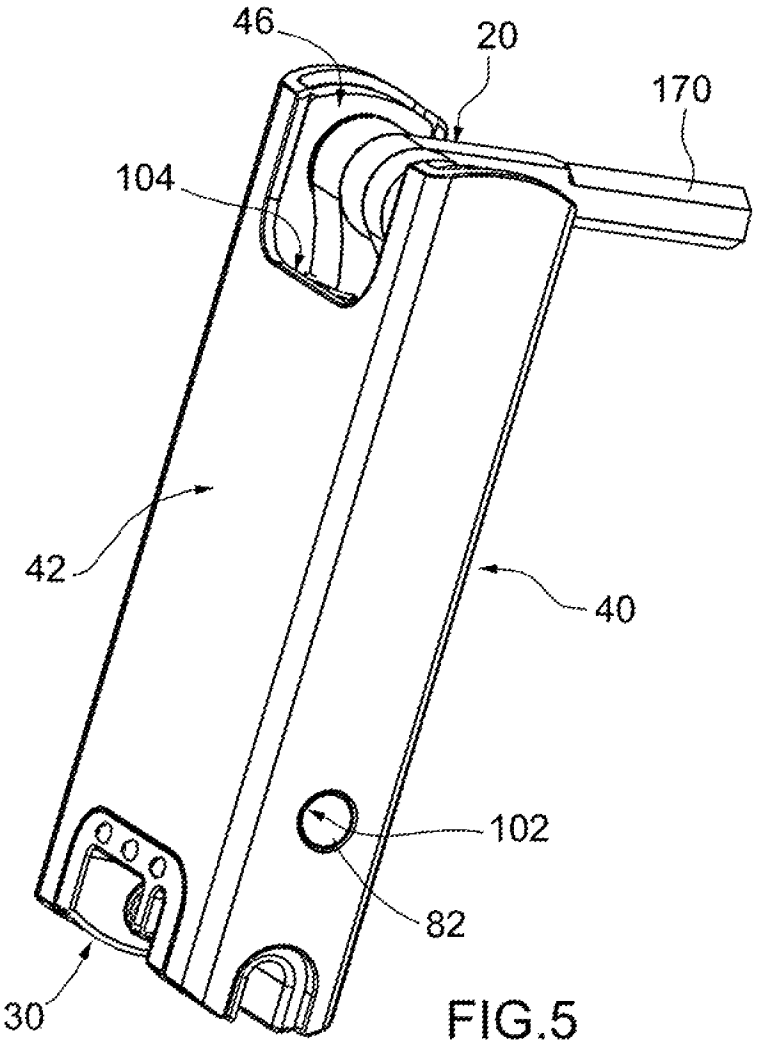
FIG. 5 is a perspective view of the multiple tool with one of its implements ready for use according to an embodiment of the present invention.

The first opening 46 comprises a respective first cutout 104 for moving at least one of the implements 170 of the tool assembly 20 in the respective working position, as shown, for example, in FIG. 5.

The carry case 40 further comprises a second opening 48 of the housing 100, see FIG. 4.

The second opening 48 is opposite to the first opening 46.

The second opening 48 defines a seat for a respective separate implement 30.

The second opening 48 comprises a respective second cutout 106 for operating the separate implement 30, as better disclosed hereafter.

In one embodiment of the present invention, the separate implement 30 comprises a chain breaker and a spoke wrench, or even just one implement chosen among chain breaker and spoke wrench.

More in detail, the separate implement 30 comprises a body 50 and a screw 70 for breaking a bicycle or motorcycle chain.

The body 50 of the separate implement 30 comprises raised portions 52 suitable to abut the second cutout 106 of the carry case 40 when the separate implement 30 is engaged in the second opening 48, see for instance FIGS. 3 and 4.

The chain breaking function is performed when the separate implement 30 is engaged in the second opening 48 of the carry case 40.

Figure 10:
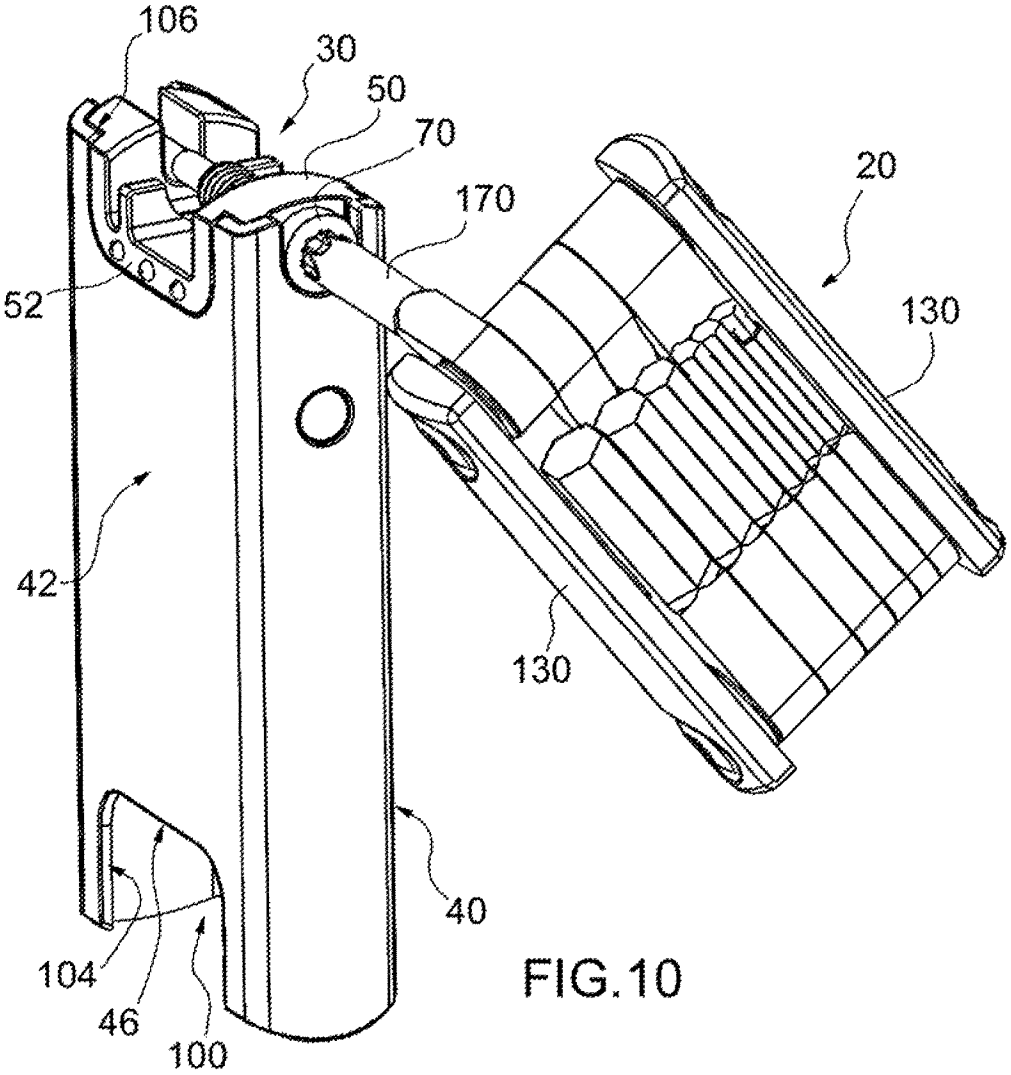
FIG. 10 is perspective view of the multiple tool with another implement ready for use according to an embodiment of the present invention.

FIG. 10 shows the multiple tool 10 according to the present invention ready to perform the chain breaking function.

In such configuration, the separate implement 30 is engaged in the second opening 48 of the carry case 40, while one of the implements 170 is used to manually turn the screw 70 within body 50.

Carry case 40, gripped by one user's hand around the grip portion 42, provides high degree of leverage for holding the separate implement 30 during chain assembly and disassembly.

The body 50 of the separate implement 30 further comprises spoke contours 32, which are suitable to fit different sized spokes.

The spoke adjusting function is performed when the separate implement 30 is removed from the carry case 40.

Figure 6:
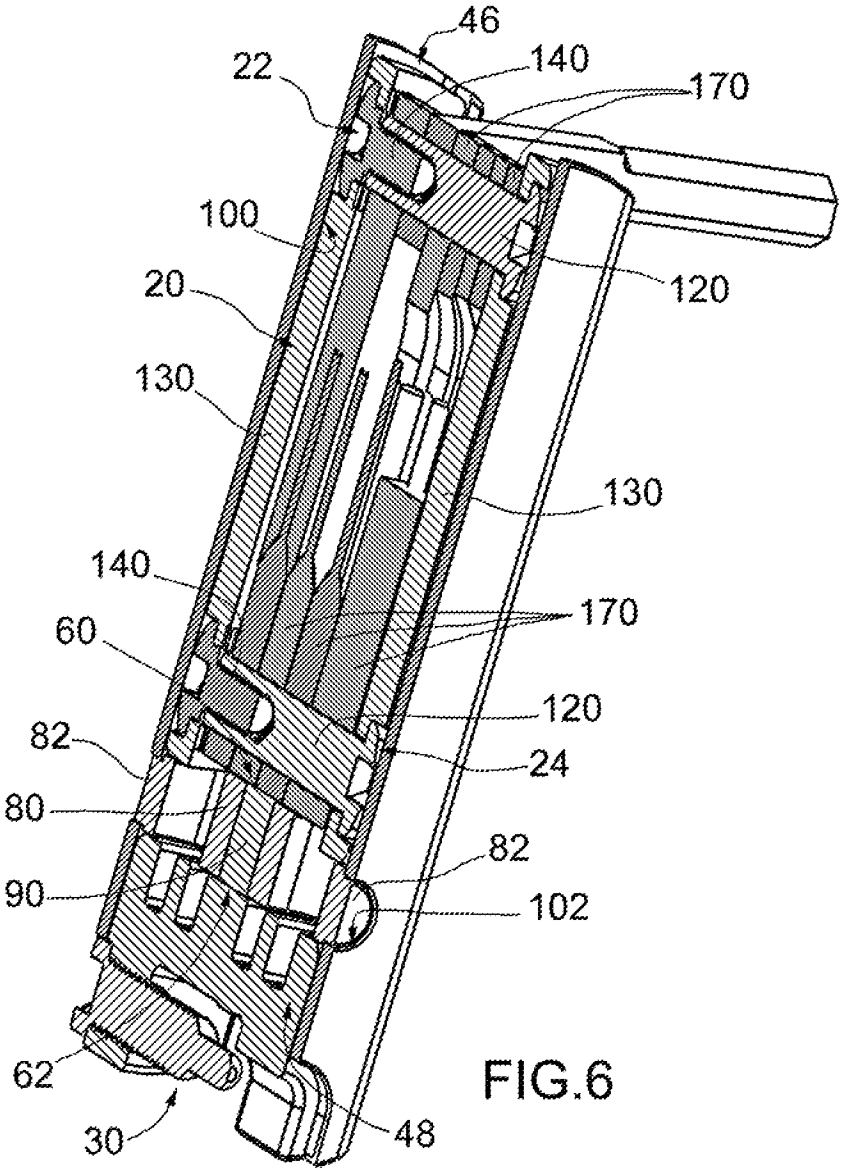
FIG. 6 is a sectional view of the multiple tool shown in FIG. 5.

According to an aspect of the present invention, the carry case 40 comprises first retention means 60 of the tool assembly 20 inside the housing 100, see for example FIG. 6.

According to a further aspect of the present invention, and referring again to FIG. 6, the carry case 40 comprises second retention means 62 of the separate implement 30 inside the housing 100, and more in detail inside the second opening 48 of the housing 100.

The first retention means 60 comprise at least a magnet 90, arranged inside the housing 100, for holding the tool assembly 20.

As well, the second retention means 62 comprise at least a magnet 90 arranged inside the housing 100, for holding the separate implement 30.

In greater detail, in one embodiment of the present invention shown in FIGS. 1-11, a single magnet 90 holds both the tool assembly 20 and the separate implement 30 inside the housing 100, from opposite sides.

In other embodiments of the present invention, not shown in the figures, different magnets could be foreseen inside the housing 100 for holding respectively the tool assembly 20 and the separate implement 30.

The first retention means 60 and/or the second retention means 62 further comprise a magnet holder 80 engaged inside the housing 100.

In greater detail, the magnet 90 is press fit into the magnet holder 80.

Magnet holder 80 can be made, for example, of polymeric material.

The carry case 40 comprises side holes 102.

Side holes 102 are foreseen through the side walls 116 of the carry case 40.

The magnet holder 80 comprises corresponding side protrusions 82 which fit the side holes 102 of the carry case 40: the magnet holder 80 is therefore securely engageable inside the housing 100 of the carry case 40.

In further embodiments of the invention, not shown in the figures, retention means of different kinds could be foreseen inside the housing 100 to retain respectively the tool assembly 20 and the separate implement 30.

The tool assembly 20 comprises, in greater detail, a first pivot 22 and a second pivot 24.

The first pivot 22 and the second pivot 24 are parallel to each other.

The first pivot 20 and the second pivot 24 are respectively connected by two side bars 130.

Figure 2:
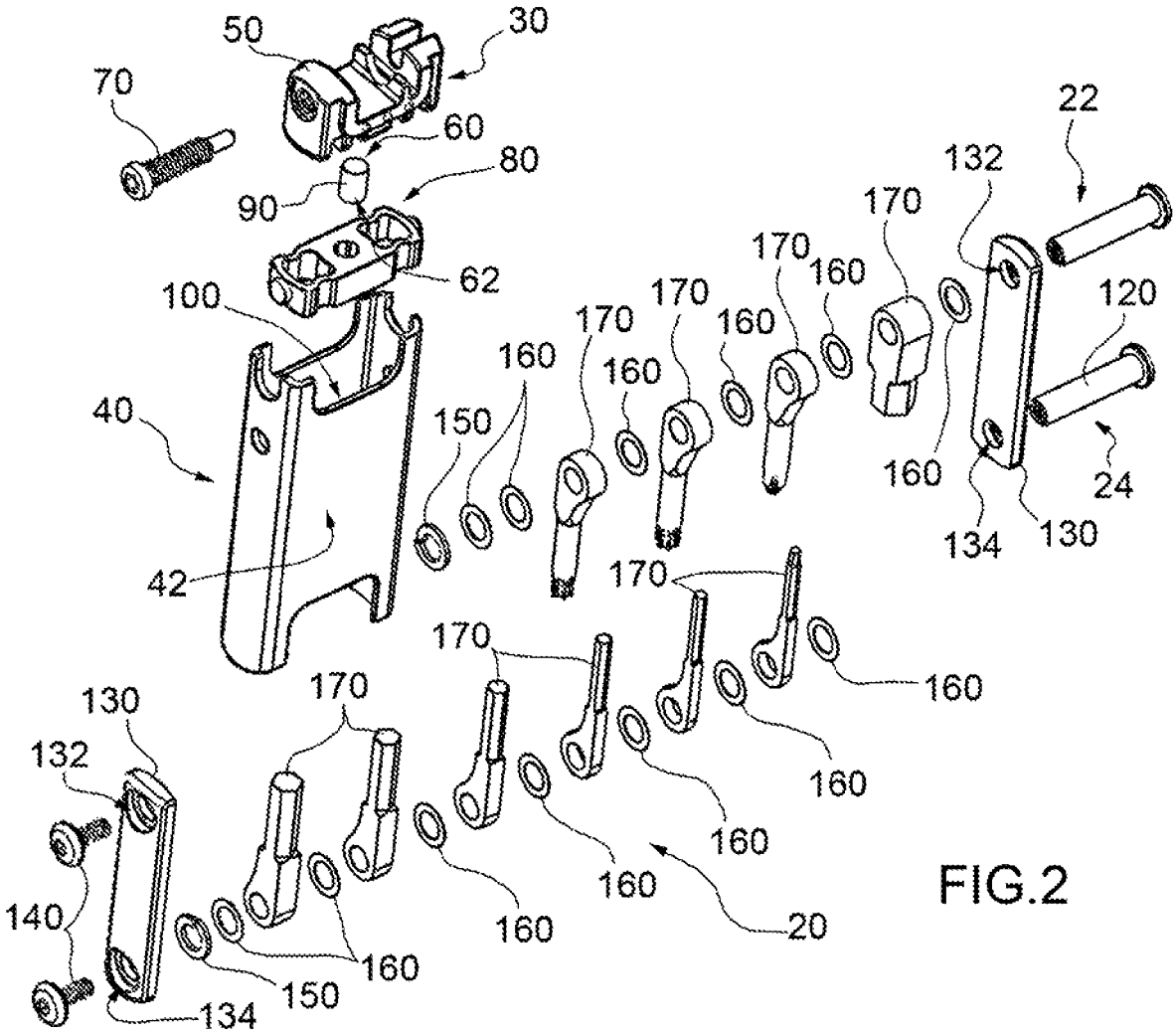
FIG. 2 is any exploded view of the multiple tool according to an embodiment of the present invention.

Each of the side bars 130 comprises a first hole 132 and a second hole 134, opposite to the first hole 132, for the respective engagement of the first pivot 22 and the second pivot 24, see FIG. 2.

In greater detail, each of the first pivot 22 and the second pivot 24 comprises a respective fastener 120 and a respective screw 140, reciprocally connected and engaged inside respective holes 132,134 of the side bars 130.

A certain number of implements 170 are inserted along each fastener 120 of the first pivot 22 and of second pivot 124.

Furthermore, a lock washer 150 and flat washers 160 are inserted along each of the fasteners 120 and among the implements 170.

Both side bars 130 of the tool assembly 20 have a cross-section which is suitably rounded outwards, in order to minimize friction along the side walls 116 of the carry case 40.

Therefore, side walls 116 are suitable for guiding side bars 130 of the tool assembly 20 during displacement of the latter inside the housing 100.

The multiple tool 10 according to the invention can be used as a traditional multiple tool, i.e., fully removed from the carry case 40 as shown in the perspective view of FIG. 3.

The multiple tool 10 can be used free of the carry case 40 in such cases where high leverage is not necessarily needed, i.e., functions that do not require a high degree of torque.

FIG. 4 shows a further perspective view of the multiple tool 10 according to the present invention where the separate implement 30 is also removed from the carry case 40.

FIG. 5 shows the multiple tool 10 according to the present invention ready for using one of its implements 170, while the tool assembly 20 is fully inserted in the carry case 40.

After a implement 170 has been pivoted into a working position, the tool assembly 20 can be put back into the carry case 40, providing a nice handle for turning and providing more leverage than using the tool assembly 20 by itself.

The first cutout 104 provides a convenient way to grasp the tool assembly 20 when inserting or removing the latter from carry case 40.

As it can be seen in the sectional view of FIG. 6, magnet 90 contacts the tool assembly 20 and retains the latter inside the housing 100.

Figure 7:
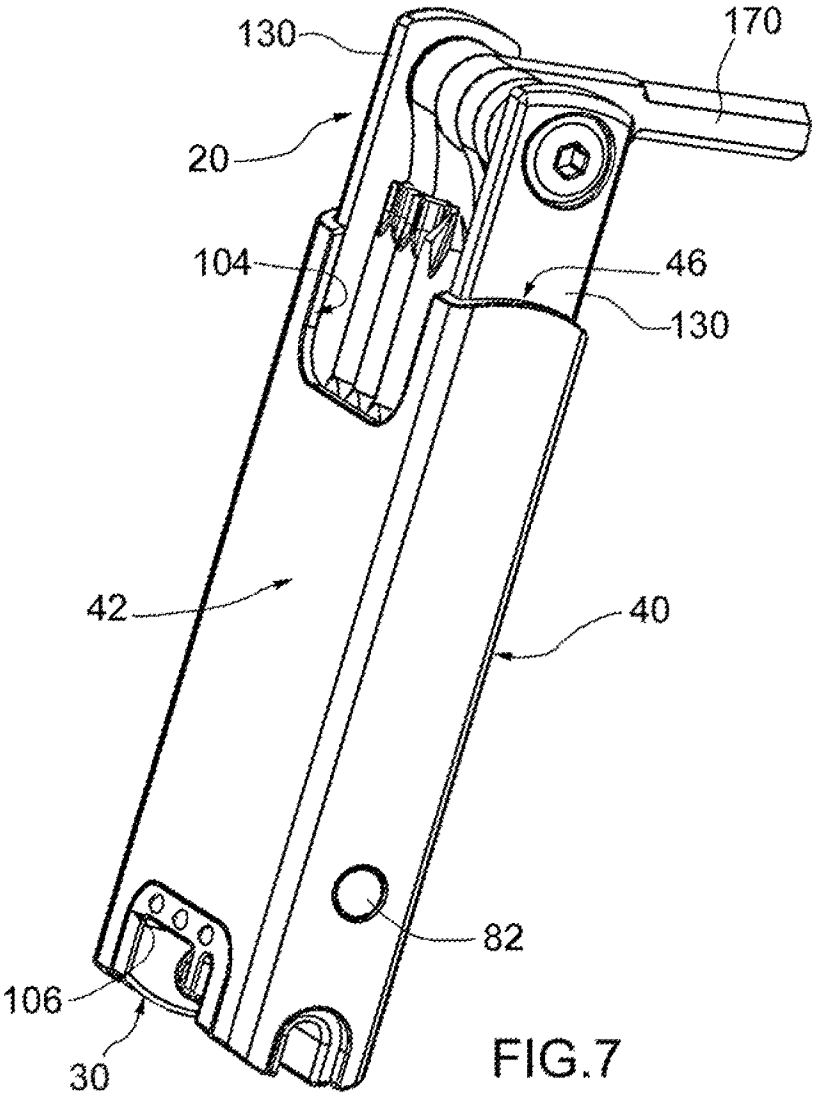
FIG. 7 is a perspective view of the multiple tool with one of its implements ready for use according to an embodiment of the present invention, with greater leverage that that shown in FIG. 5.
Figure 9:
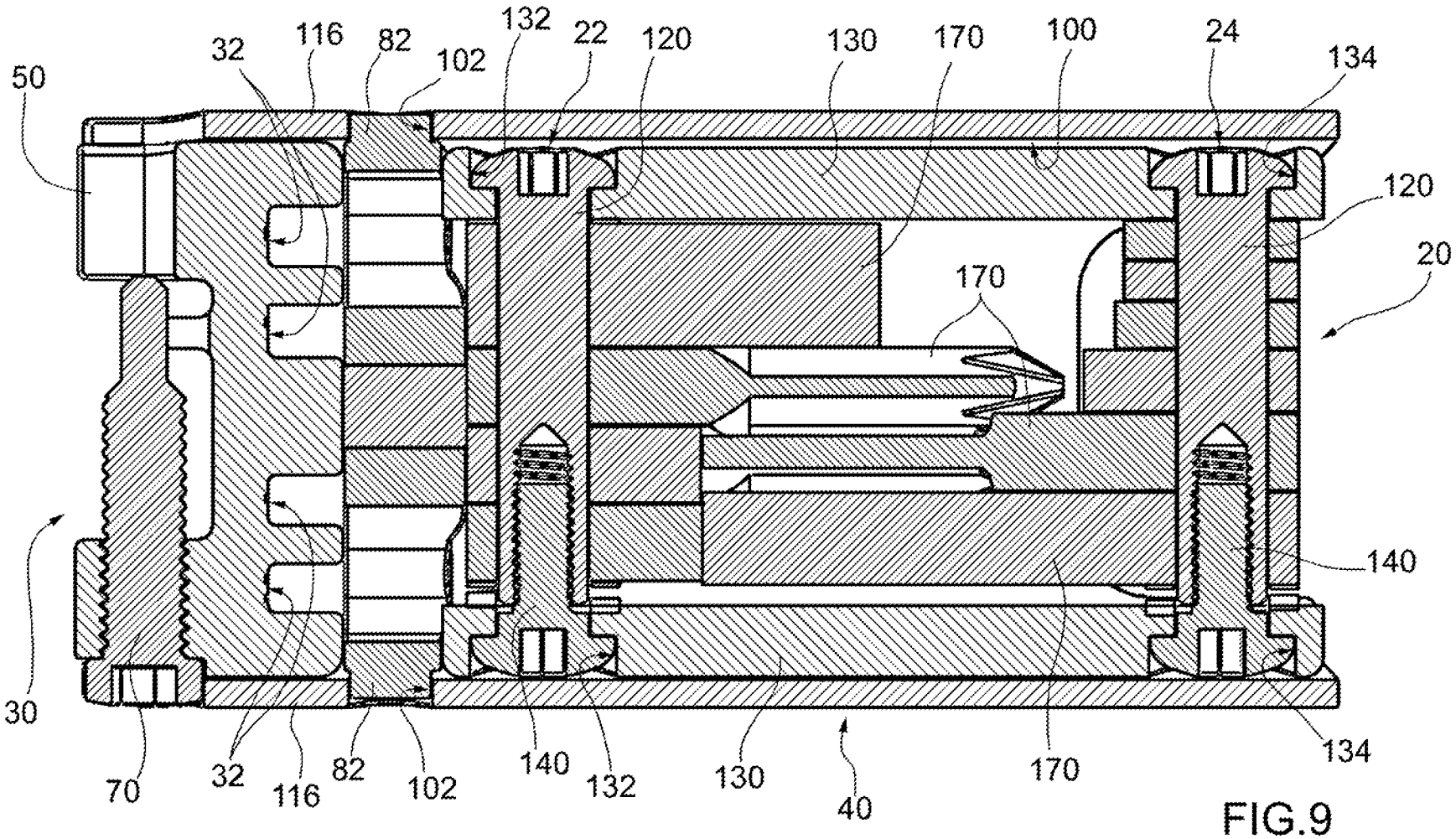
FIG. 9 is a sectional view of the multiple tool according to an embodiment of the present invention.

FIG. 7 shows the multiple tool 10 according to the present invention ready for using one of its implements 170, with greater leverage than that shown in FIG. 5.

The tool assembly 20 is in fact simply slid partially out of the carry case 40 to achieve greater turning leverage.

Figure 8:
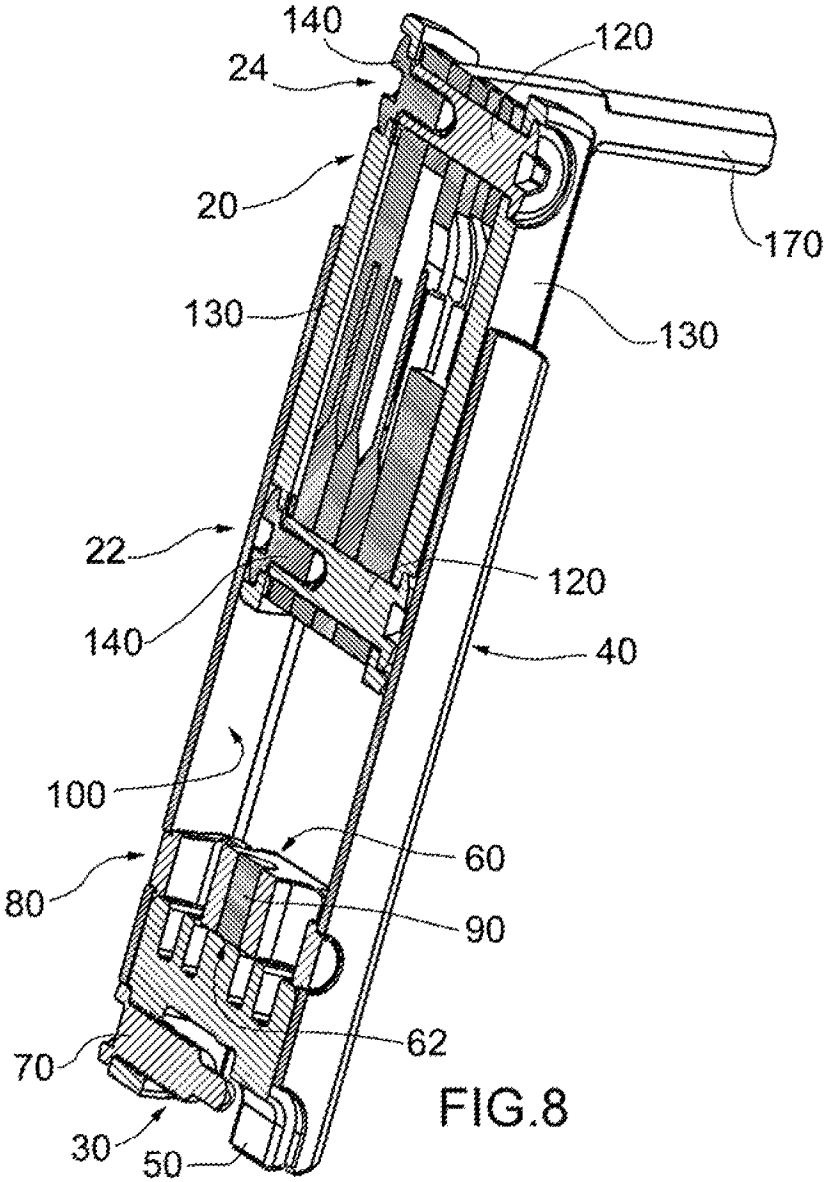
FIG. 8 is a sectional view of the multiple tool shown in FIG. 7.

As it can be seen in the sectional view of FIG. 8, magnet 90 is no longer in contact with the tool assembly 20.

Figure 11:
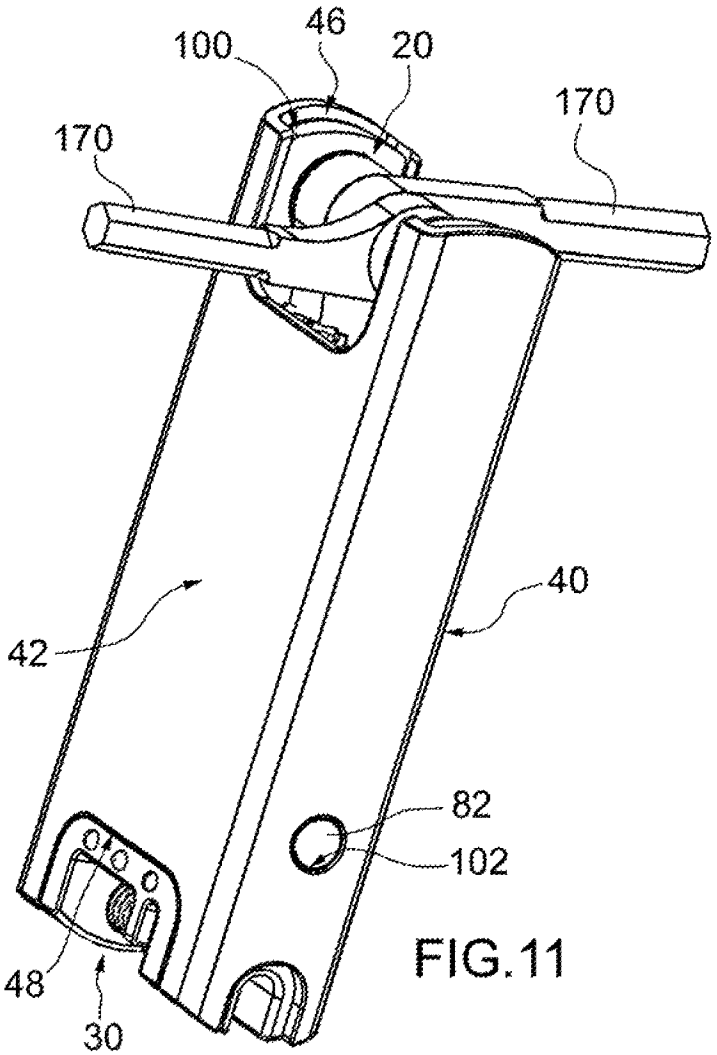
FIG. 11 is a perspective view of the multiple tool with two implements ready for use according to an embodiment of the present invention.

FIG. 11 shows the multiple tool 10 according to the present invention ready for using two of its implements 170.

The first cutout 104 provides room for two or more implements 170 to protrude through, enabling fast use of multiple implements without the need to remove and install the tool assembly 20 out of and into carry case 40.

As mentioned, the integration of the tool assembly with a carry case according to the present invention provides great leverage when using the tools, as well as keeping the tools closed during storage. Furthermore, the carry case protects the user's hand from the tool's sharp edges while holding or carrying the tool.

Because of the magnetic attachment between the carry case and the tool assembly, no carry case lid is needed, and conveniently there is no lid to loose.

The present invention has been described according to various embodiments, but equivalent variants can be devised without departing from the scope of protection offered by the following claims.

The invention claimed is:

1. A multiple tool with an integrated case, comprising:

a tool assembly comprising a first pivot and a second pivot, wherein:

the first pivot and the second pivot hold a plurality of respective metallic implements, each of the metallic implements are rotatable from an inactive position to a working position, the metallic implements comprise a wrench, an allen key, or a screwdriver, and the first pivot and the second pivot are respectively connected by two side bars;

a carry case, which is substantially rectangular tubular shaped, that houses the tool assembly and comprises:

a housing for the tool assembly, the housing comprising a first opening and a cavity defined by a front wall, a rear wall, and side walls, wherein the side walls are configured to guide the two side bars inside the housing during displacement of the tool assembly, at least a grip portion, disposed on an external surface of the carry case, that facilitates manually holding the tool assembly when at least one of the metallic implements is in its working position, and a second opening, which is opposite to the first opening, that defines a seat for a separate implement, wherein the tool assembly is configured to be partially extracted from the first opening to increase manual leverage when using one of the metallic implements or to be fully extracted from the carry case; and a magnet inside the cavity of the housing to hold the tool assembly, wherein the magnet holds both the tool assembly and the separate implement inside the housing from opposite sides, and the magnet contacts the metallic implements of the tool assembly and retains the tool assembly inside the housing.

2. The multiple tool of claim 1, wherein the first opening comprises a first cutout configured to receive at least one of the metallic implements.

3. The multiple tool of claim 1, wherein the second opening comprises a second cutout.

4. The multiple tool of claim 3, wherein the separate implement comprises a body provided with raised portions suitable to abut the second cutout.

5. The multiple tool of claim 4, wherein the body comprises slots that are configured to fit different sized spokes.

6. The multiple tool of claim 1, wherein the separate implement comprises a chain breaker or a spoke wrench.

7. The multiple tool of claim 1, wherein the carry case further comprises a magnet holder engaged into the housing.

8. The multiple tool of claim 7, wherein the carry case further comprises side holes disposed through its side walls, wherein the magnet holder comprises corresponding side protrusions that fit the side holes.

9. The multiple tool of claim 1, wherein the carry case comprises aluminum.

10. The multiple tool of claim 1, wherein the separate implement comprises a body and a screw configured to break a bicycle or motorcycle chain.

11. The multiple tool of claim 1, wherein the first pivot and the second pivot each comprise a fastener and a screw.

* * * * *